United States Patent [19]

Gollel

[11] 4,112,955

[45] Sep. 12, 1978

[54] COIN OPERATED ULTRASONIC CLEANING DEVICE

[76] Inventor: Richard M. Gollel, 1148 Vroom Rd., Spencerport, N.Y. 14559

[21] Appl. No.: 761,305

[22] Filed: Jan. 21, 1977

[51] Int. Cl.[2] ..... B08B 3/04; B08B 3/12

[52] U.S. Cl. ..... 134/57 R; 134/143; 134/184

[58] Field of Search ..... 134/1, 57 R, 57 DL, 134/143, 184, 58 R, 58 DL, 84, 92, 111, 201

[56] References Cited

U.S. PATENT DOCUMENTS

| | | | |
|---|---|---|---|
| 424,894 | 4/1890 | Murphey | 134/143 |
| 2,627,276 | 2/1953 | Eggleton | 134/143 |
| 2,888,939 | 6/1959 | Nitsche | 134/1 X |
| 2,896,649 | 7/1959 | Faidley | 134/1 X |
| 2,974,070 | 3/1961 | Van Dongeren | 134/1 |
| 3,068,875 | 12/1962 | Lovercheck | 134/58 DL |
| 3,099,991 | 8/1963 | Pion et al. | 134/143 |
| 3,101,089 | 8/1963 | Brown et al. | 134/1 X |

*Primary Examiner*—Robert L. Bleutge
*Attorney, Agent, or Firm*—Fred L. Denson

[57] ABSTRACT

A novel coin operated ultrasonic device for cleaning jewelry and other small household items is described. The device is designed for usage in public places and has a cleaning chamber, a cover for the chamber and a basket. When not in use, the cover remains in a locked position by an electromagnetic latch which is responsive to coin actuated circuitry. Upon insertion of a coin, power is supplied to the device for a given period of time. The power supplied causes the electromagnetic latch to become activated thereby permitting the cover to be opened. A hook is attached to the underside of the cover and is designed to suspend a workpiece such as a ring, necklace or bracelet in a cleaning solution disposed in the cleaning chamber while the cover is closed. A porous basket is situated within the chamber to insure that the workpiece is retrievable from the cleaning liquid in the event it should become disengaged from the hook. The ultrasonic cleaning circuitry is operated for a pre-set period responsive to the insertion of a coin into the device which permits power to be supplied to the circuitry for the given period.

1 Claim, 5 Drawing Figures

FIG. 2
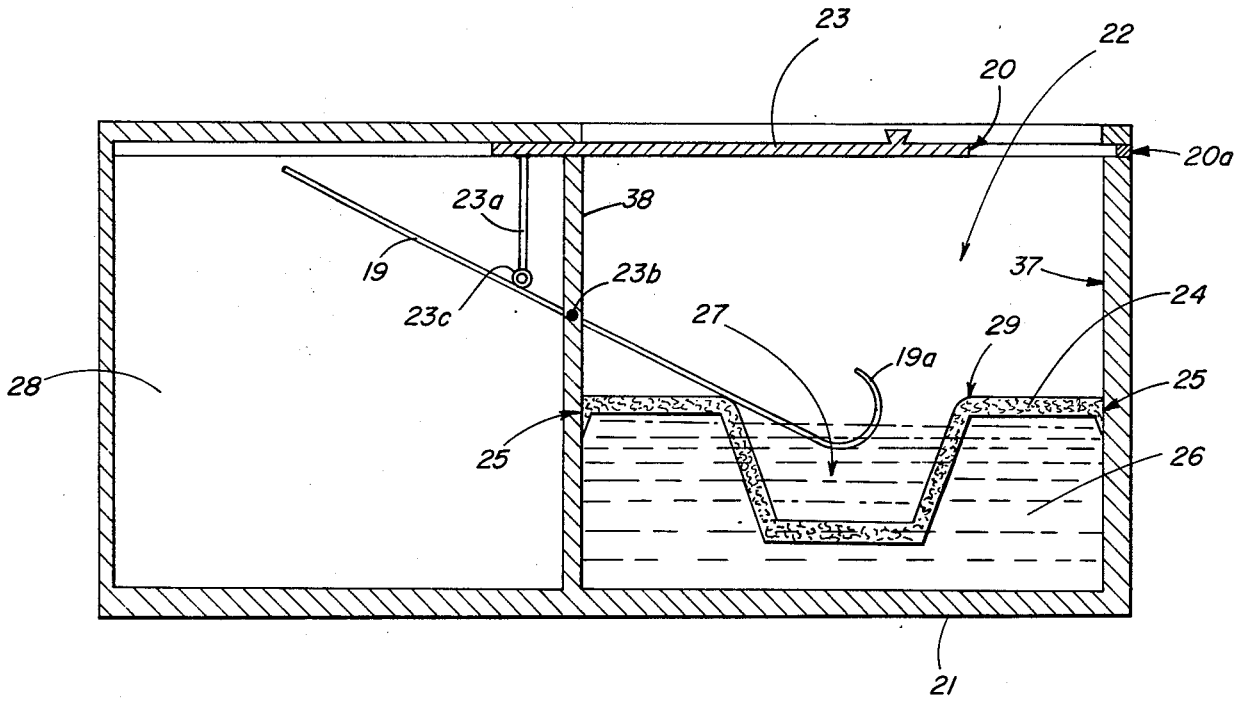
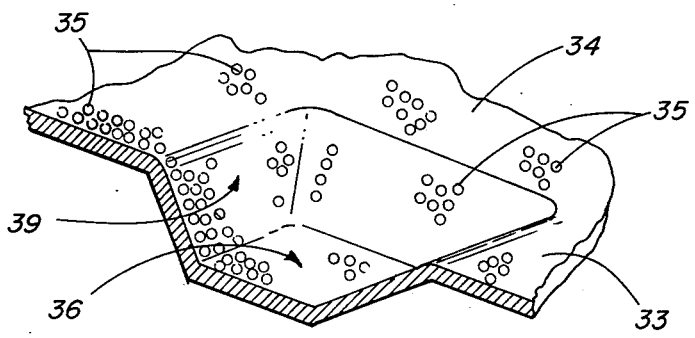
FIG. 3

COIN OPERATED ULTRASONIC CLEANING DEVICE

BACKGROUND OF THE INVENTION

This invention relates to coin operated devices for ultrasonically cleaning jewelry.

Ultrasonic cleaning devices are widely used for cleaning various items. They are characterized by high cleaning efficiency in relatively short times and are widely used in industry and laboratories. Even though they are capable of cleaning jewelry such as rings, necklaces, bracelets, earrings etc. as well as other small household items, they are rather uncommon in homes primarily because of their relatively infrequent usage (compared to industrial usages). This infrequent usage is attributable among other things to the fact that household items such as jewelry do not need to be cleaned on a regular basis. Thus, many people are deprived of the efficient benefits resulting from ultrasonic cleaning merely because the infrequent usage does not justify the purchase price of the device.

It is therefore an object of this invention to provide a coin operated ultrasonic cleaning device for use by consumers who do not desire to purchase one.

It is another object of this invention to provide a coin operated ultrasonic cleaning device which is capable of being used in public places.

It is yet another object of this invention to provide a coin operated ultrasonic cleaning device which can be locked.

A further object of this invention is to provide a coin operated ultrasonic cleaning device which permits convenient retrieval of a workpiece from the cleaning solution.

SUMMARY OF THE INVENTION

These and other objects of the invention are accomplished with a novel coin operated ultrasonic device for cleaning jewelry as well as other small household items. The device is designed for usage in public places and has a cleaning chamber, a cover for the chamber, and a basket. When not in use, the cover remains in a locked position by an electromagnetic latch which is responsive to coin actuated circuitry. Upon insertion of a coin, power is supplied to the device for a given period of time. The power supplied causes the electromagnetic latch to become activated thereby permitting the cover to be opened. A hook is attached to the underside of the cover and is designed to suspend a workpiece such as a ring, necklace or bracelet in a cleaning solution disposed in the cleaning chamber while the cover is closed. A porous basket is situated whithin the chamber to insure that the workpiece is retrievable from the cleaning liquid in the event it should become disengaged from the hook. The ultrasonic cleaning circuitry is operated for a pre-set period responsive to the insertion of a coin into the device which permits power to be supplied to the circuitry for the given period. Additional features and advantages of the present invention will become more apparent from the following description of the preferred embodiments taken in conjunction with the accompanying drawings.

BRIEF DESCRIPTION OF THE DRAWINGS

FIG. 2 is a sectional view of the novel coin operated ultrasonic cleaning device of this invention taken along line A—A of FIG. 1.

FIG. 3 is a cut-away view showing the basket design used in conjunction with the device of FIG. 2.

DETAILED DESCRIPTION OF THE INVENTION

Figure 1:
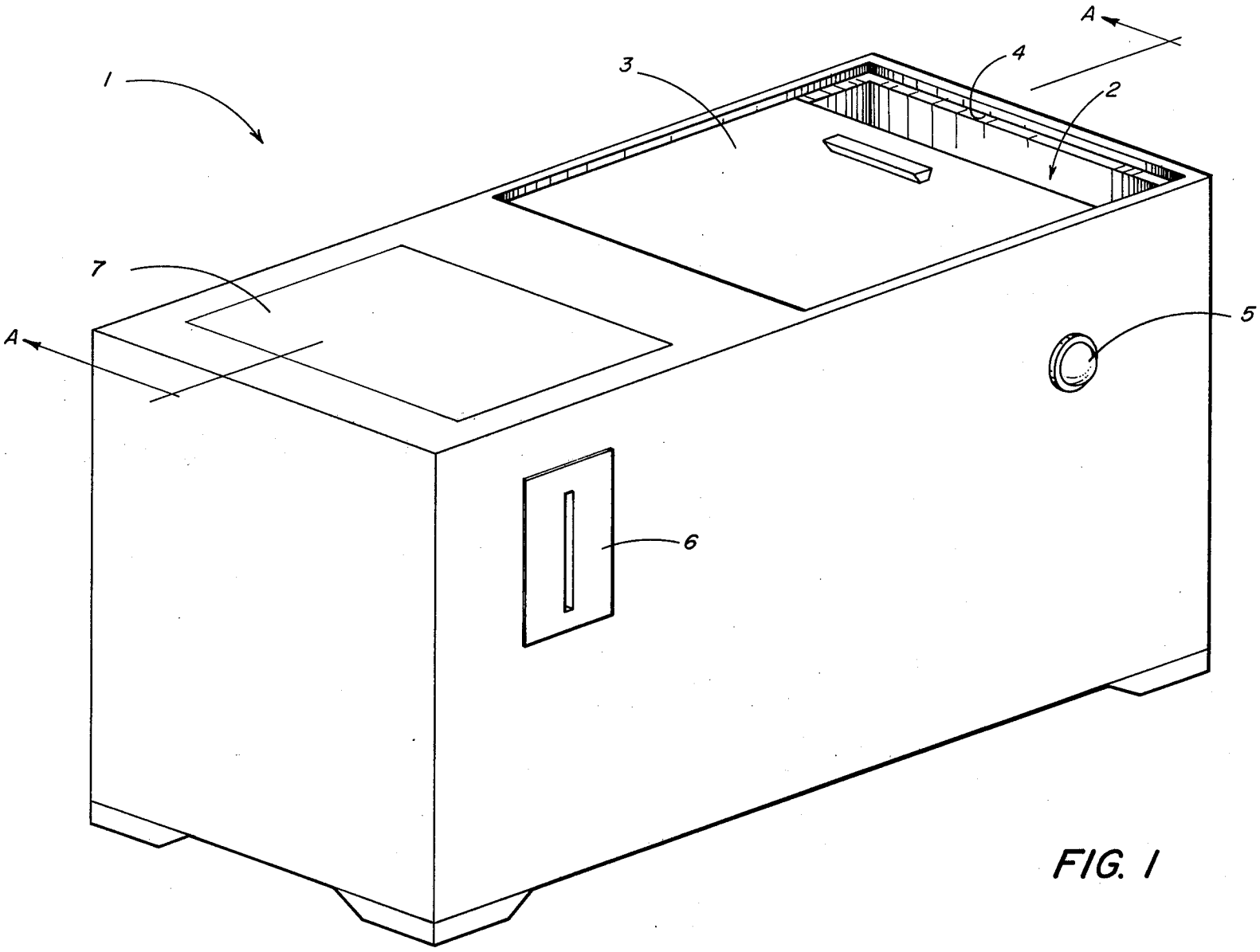
FIG. 1 is a perspective view of the novel coin operated ultrasonic cleaning device of this invention.

The coin operated ultrasonic cleaning device 1 of FIG. 1 contains cleaning chamber 2 with a slidably mounted cover 3 which is supported by ledge 4. As explained below, the cover 3 is latched by an electromagnet which operates in response to a coin inserted in slot 6. Light 5 remains on while the machine is in operation. The top of the machine contains operating instructions printed on plate 7 or other descriptive material.

As shown in FIG. 2, cleaning chamber 22 is formed by bottom 21 and vertical walls 37 and 38. Basket 29 is made from any porous material such as wire mesh and is secured to the walls at 25. The basket is designed in a manner such that its center portion extends into cleaning liquid 26. Cover 25 is slidably mounted atop cleaning chamber 22. When in the closed position, the leading edge 20 of cover 23 may be locked in position by electromagnetic latch **20*a* which is activated responsive to a coin inserted in slot 6 of FIG. 1. Coin responsive electromagnetic latches of the type employed herein are well known in the art. Attached to the underside of cover 23 near the end opposite latch 20*a* is actuating arm 23*a*. Arm 23*a* comprises an elongated member having roller 23*c* attached to the end thereof. A hook having a curved portion 19*a* and a straight portion 19 extends through wall 38 and is pivotably attached thereto by pin 23*b* or other suitable means. The hook is used to lower the article being cleaned into the cleaning solution 26 when cover 23 is closed and to remove the article when cover 23 is opened. When cover 20 is moved to the open position, actuating arm 23*a* and roller 23*c* cause the straight portion 19 of the hook to be lowered and the hook portion 19*a* to be raised out of the cleaning solution. Upon closing cover 23, the hook portion 19*a* is lowered into the solution. Contained within area 28 are the necessary electronic circuitry for providing ultrasonic vibrations for cleaning purposes. Such circuitry is well known in the art and is typically described in U.S. Pat. No. 2,896,649 and U.S. Pat. No. 3,771,772. Area 28** also contains circuitry for the operation of the coin responsive electromagnetic latch. The latch may be operated on a timed-out basis, that is, upon insertion of a coin, the electromagnet will become operative for a given period of time which is generally commensurate with the time required for cleaning the workpiece. Insertion of the coin also permits power to be supplied to the device for a given period of time. Coin controlled electric switches for controlling the flow of power to devices are well known in the art and are typically described in U.S. Pat. No. 1,766,354.

As shown in FIG. 3, basket 34 is comprised of any porous material such as wire mesh having openings 35. The basket has a bottom 36 and sides 39 which are immersed below the surface of the cleaning material. Ledge 33 is attached to wall 25 of the cleaning chamber.

Figure 4:
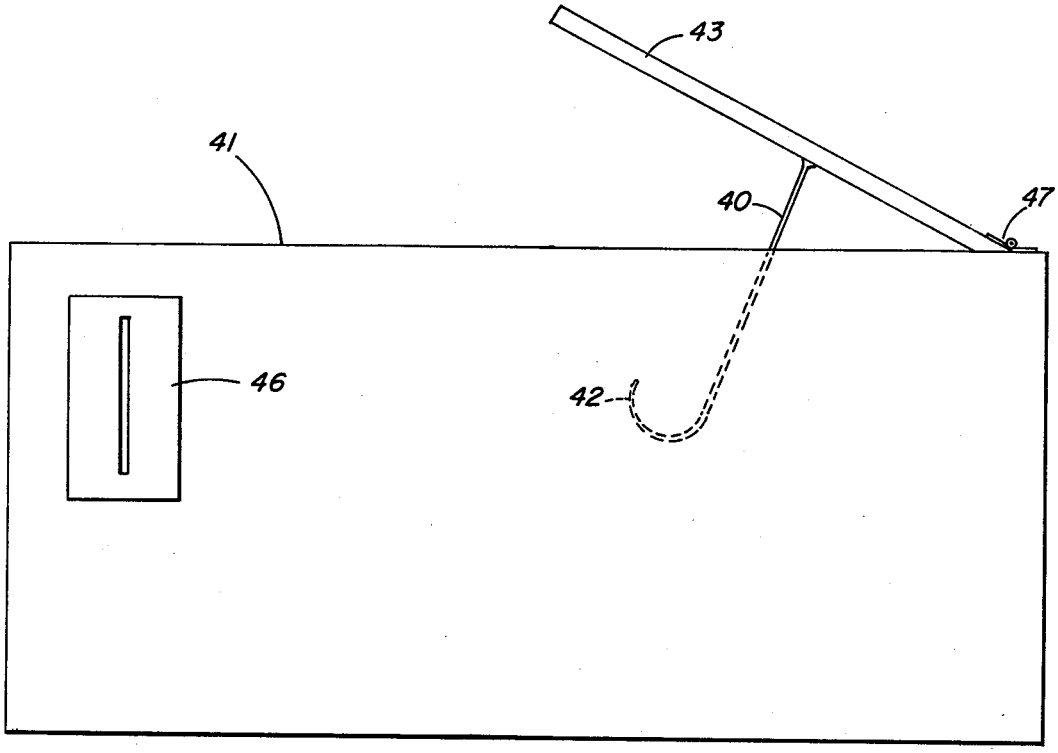
FIG. 4 is a side view of a coin operated ultrasonic cleaning device comprising an alternative embodiment of the invention.
Figure 5:
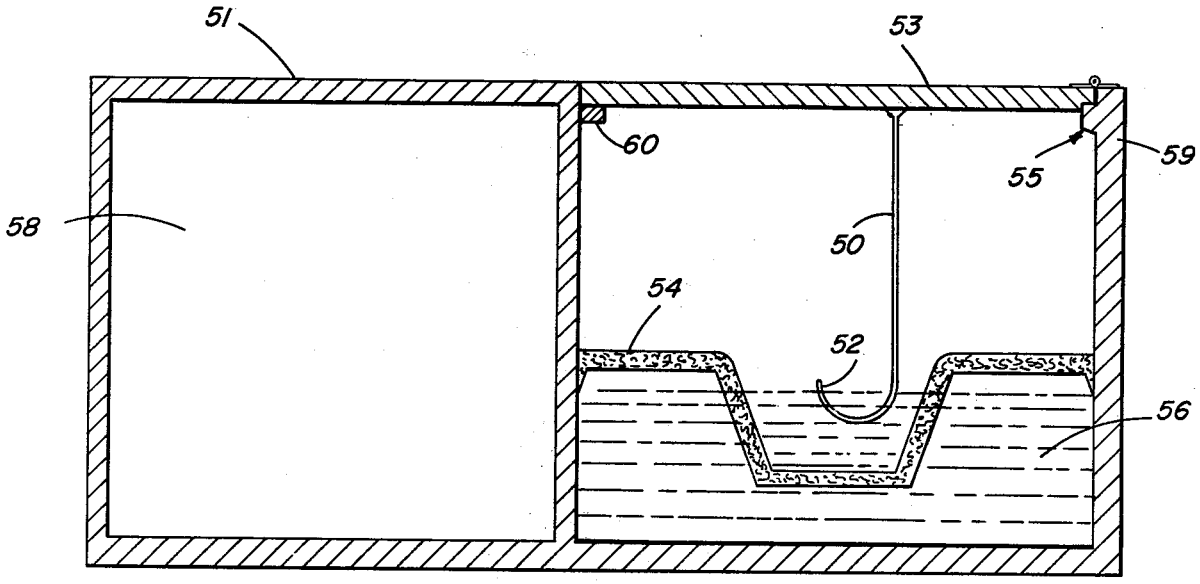
FIG. 5 is a sectional view of the alternative embodiment of the invention set forth in FIG. 4.

FIGS. 4 and 5 depict another embodiment of the invention. In FIG. 4, cover 43 is attached to the upper edge of the wall of the cleaning chamber by hinge 47. A hook having a straight portion 40 and a curved portion 42 is attached to the underside of the cover. FIG. 5 shows cover 53 containing hook 50 and 52 attached to its underside. Electromagnetic latch 60 is activated responsive to the insertion of a coin into slot 46 (FIG. 4). Upon insertion of a coin, power is supplied to the device 51 thereby placing latch 60 in an unlocked state and permitting cover 53 to be opened. Power is also simultaneously furnished to the ultrasonic circuitry causing it to be activated for a given period of time.

In operation, the device remains locked until a coin is placed in slot 6. The insertion of the coin allows the cover 3, 23 or 43 to be opened and also activates the ultrasonic circuitry for a pre-set period of time. The jewelry to be cleaned, such as a ring, is placed on hook 19*a*, 42 or 52. The cover is then closed but remains unlocked while power is supplied to device 41. The jewelry is lowered into basket 27 during the cleaning process. The bottom of the basket is well below the surface of the cleaning liquid 26, 56 which insures complete immersion of the workpiece into the liquid. Upon completion of the cleaning process, the cover is opened, the hook containing the workpiece is withdrawn from the cleaning liquid and the workpiece removed therefrom The cover is again closed and upon completion of the timing cycle, power to the device is discontinued causing the electromagnetic latch to become deactivated thereby locking the cover in position until another coin is inserted into the slot.

Since the device is designed to be used by the public in public places, it is essential that all elements in the device be readily securable. To achieve this end, the basket is secured to the walls of the cleaning chamber. In the event the workpiece should become disengaged from the hook, the operator need only retrieve the piece from the basket by using another hook or similar device. While the ultrasonic circuitry is shown positioned in area 28 beside the cleaning chamber 22, the device may be designed so that this and other required circuitry are positioned below the cleaning chamber 22. The time and intensity of the cleaning cycle is optional with the designer and is dependent upon the particular circuitry employed. The device can be made operable with any type of coin desired by the user. It is designed to be generally disposed in any place where there is public traffic such as barber shops, hotel lobbies, airports, etc.

The invention has been described in detail with particular reference to certain preferred embodiments thereof, but it will be understood that variations and modifications can be effected within the spirit and scope of the invention.

I claim:

1. A coin operated ultrasonic cleaning device comprising:

a. a cleaning chamber for holding a cleaning liquid, said chamber having a bottom and vertical walls;

b. a cover for said chamber;

c. a coin controlled electromagnetic latch for locking and unlocking said cover;

d. a material receiving basket attached to the walls of said chamber;

e. a hook connected to the cover for lowering and raising the workpiece to be cleaned into and out of said basket, said hook being lowered into the basket when the cover is closed and being raised from the basket when the cover is opened; and f. a source of ultrasonic vibrations positioned adjacent to the cleaning chamber; wherein the cover is slidably mounted at the upper end of the cleaning chamber, an actuating arm is positioned on the underside of the cover and attached thereto, and said hook extends through the wall of the cleaning chamber and is pivotably attached thereto whereby the straight portion of the hook is in communication with the actuating arm outside of the cleaning chamber and the curved portion of the hook is movably positionable inside of the cleaning chamber responsive to the position of said cover.

* * * * *